US005586894A

United States Patent [19]

Taniuchi et al.

[11] Patent Number: 5,586,894

[45] Date of Patent: Dec. 24, 1996

[54] MULTIPLE LEVER CONNECTOR ASSEMBLY

[75] Inventors: Osamu Taniuchi; Nakata Hiroyuki, both of Yokkaichi, Japan

[73] Assignee: Sumitomo Wiring Systems, Ltd., Mie Pref., Japan

[21] Appl. No.: 343,898

[22] Filed: Nov. 17, 1994

[30] Foreign Application Priority Data

| | | | |
|---|---|---|---|
| Nov. 18, 1993 | [JP] | Japan | 5-066819 U |
| Nov. 18, 1993 | [JP] | Japan | 5-066820 U |
| Nov. 19, 1993 | [JP] | Japan | 5-066836 U |

[51] Int. Cl.[6] ..... H01R 13/62

[52] U.S. Cl. ..... 439/157

[58] Field of Search ..... 439/152, 153, 439/155, 157, 372

[56] References Cited

U.S. PATENT DOCUMENTS

| | | | |
|---|---|---|---|
| 4,241,966 | 12/1980 | Gomez | 439/157 |
| 4,447,101 | 5/1984 | Gugliotti | 439/153 |
| 4,469,393 | 9/1984 | Chewning, Jr. et al. | 439/717 |
| 4,995,821 | 2/1991 | Casey | 439/372 |
| 5,269,696 | 12/1993 | Okada et al. | 439/157 |

FOREIGN PATENT DOCUMENTS

| | | |
|---|---|---|
| 0459448 | 12/1991 | European Pat. Off. . |
| 6-119955 | 4/1994 | Japan . |

*Primary Examiner*—Gary F. Paumen
*Assistant Examiner*—Brian J. Biggi
*Attorney, Agent, or Firm*—Wenderoth, Lind & Ponack

[57] ABSTRACT

A multiple lever connector assembly includes a plurality of male and female connector housings accommodating terminals. Each male connector housing has a pair of lever support shafts, with a shaft protruding from each side wall and an operating lever having two bearing holes in which the lever support shafts of each male connector housing are fitted, so that the operating levers are rotatably mounted. The female connector housings include a plurality of cam action sections formed by projections for displacing the male and female connector housings by the cam action of the operating levers so that the male and female connector housings are moved together and apart. The male connector housings are coupled by a coupling member so that the housings are arranged side by side with a predetermined clearance between one of the side walls of each male connector housing and one of the side walls of the adjacent male connector housing opposite the one of the side walls of each first connector housing. The clearance is set to be smaller than a depth of fit between the lever support shafts and the respective bearing holes of the operating levers.

10 Claims, 16 Drawing Sheets

Prior Art

MULTIPLE LEVER CONNECTOR ASSEMBLY

BACKGROUND OF THE INVENTION

1. Field of the Invention

This invention relates to a lever connector having an operating lever which is operated so that male and female connectors from each other are mated together and unmated utilizing the principles of the lever, and more particularly to a multiple lever connector assembly having a plurality of connector housings integrally coupled to one another so that they are arranged side by side.

2. Description of the Prior Art

A multiple lever connector assembly having a plurality of connector housings integrally coupled to one another side by side has recently been provided. For example, FIG. 19 shows a twin lever connector assembly. Two male connector housings 1 are integrally coupled to each other so as to be arranged right and left in parallel with each other. Each male connector housing 1 has two lever support shafts 2 protruding from right-hand and left-hand side walls thereof respectively. A gate-shaped operating lever 3 having two cam grooves is rotatably mounted on the lever support shafts 2 of each male connector housing 1 so as to straddle the same. Each male connector housing 1 has two outer walls formed integrally therewith to be located outside both sides of the operating lever 3 respectively. The outer walls 4 restrict the movement of the lever 3 so that it can be prevented from being disconnected from the lever support shafts 2 when rotatively moved.

In the assembling of the above-described multiple lever connector assembly, the operating lever 3 is mounted on the connector housing 1 by inserting the lever support shafts 2 into shaft holes 3*a* thereof respectively. Each leg of the operating lever 3 is expanded outwardly by the length of each lever support shaft 2 when the lever support shafts 2 of the connector housing 1 are inserted into the respective shaft holes 3*a*. Accordingly, the outer walls 4 are pushed outwardly by the respective legs of the operating lever 3.

Since the outer walls 4 are located at both sides of each male connector housing 1 in the above-described conventional construction, the two male connector housings are coupled together with space allowing elastic deformation of the two outer walls 4 therebetween. Consequently, the lateral dimension of the multiple lever connector assembly is increased, which poses a problem.

SUMMARY OF THE INVENTION

The present invention has been made in view of the above-described problem and an object of the present invention is to provide a multiple lever connector assembly wherein the overall lateral dimension of a plurality of connector housings coupled to one another side by side can be reduced.

To achieve the object, the present invention provides a multiple lever connector assembly characterized in that a plurality of first connector housings, on each of which an operating lever is mounted, are coupled to one another so as to be arranged side by side with a predetermined clearance between one of the side walls of each first connector housing and one of the side walls of the adjacent first connector housing opposite said one of the side walls of each first connector housing and that the clearance is set so as to be smaller than a depth of fit between the lever support shafts and the respective bearing holes of the operating levers.

According to the above-described construction, the operating levers are first mounted on the respective first connector housings in the assembling of the multiple lever connector assembly. Subsequently, the first connector housings are coupled to one another by a coupling member so that they are arranged side by side. Then the clearances are each set to be smaller than the depth of fit between the lever support shafts and the respective bearing holes of the operating levers. Each operating lever is subjected to excessive resistance and is expanded to be thereby displaced in such a direction that one or both of the lever support shafts fall out of the bearing shafts when each operating lever is rotatively moved for the mating and unmating of the connectors. However, the movement of each operating lever can be restricted by the side face of the operating lever of the adjacent first connector housing. Consequently, the operating levers can be prevented from disconnecting from the respective connector housings without the outer walls disposed outside the respective operating levers of the conventional multiple lever connector assembly.

In a modified form, the first connector housings on which the operating levers are to be mounted respectively are coupled to one another side by side with a clearance between one of the side walls of each first connector housing and the side wall of the adjacent first connector housing. A plurality of restricting members are disposed in the clearances after the operating levers have been mounted on the first connector housings, respectively.

Also, in the above-described construction the operating levers can be prevented from disconnecting from the lever support shafts of the first connector housings by the restricting members. Consequently, the construction eliminates provision of the outer walls employed in the conventional multiple lever connector. Furthermore, since the clearance between the side walls of the adjacent connector housings has such a width that the operating lever is allowed to flex therein, each connector housing can be disposed closer to the adjacent connector housing as compared with the conventional construction.

In another modified form, each operating lever has two projection accommodating grooves formed therein and extending from edges thereof to the bearing holes thereof for guiding the lever support shafts respectively when mounted on each first connector housing. Since each groove is recessed, an amount of flexure of each operating lever can be reduced though each lever is flexed when mounted on the first connector housing. Consequently, an outer wall of each connector housing can be prevented from being forced to expand outwardly.

BRIEF DESCRIPTION OF THE DRAWINGS

Other objects, features and advantages of the present invention will become clear upon reviewing the following description of the preferred embodiment thereof, made with reference to the accompanying drawings, in which.

DESCRIPTION OF THE PREFERRED EMBODIMENTS

Figure 1:
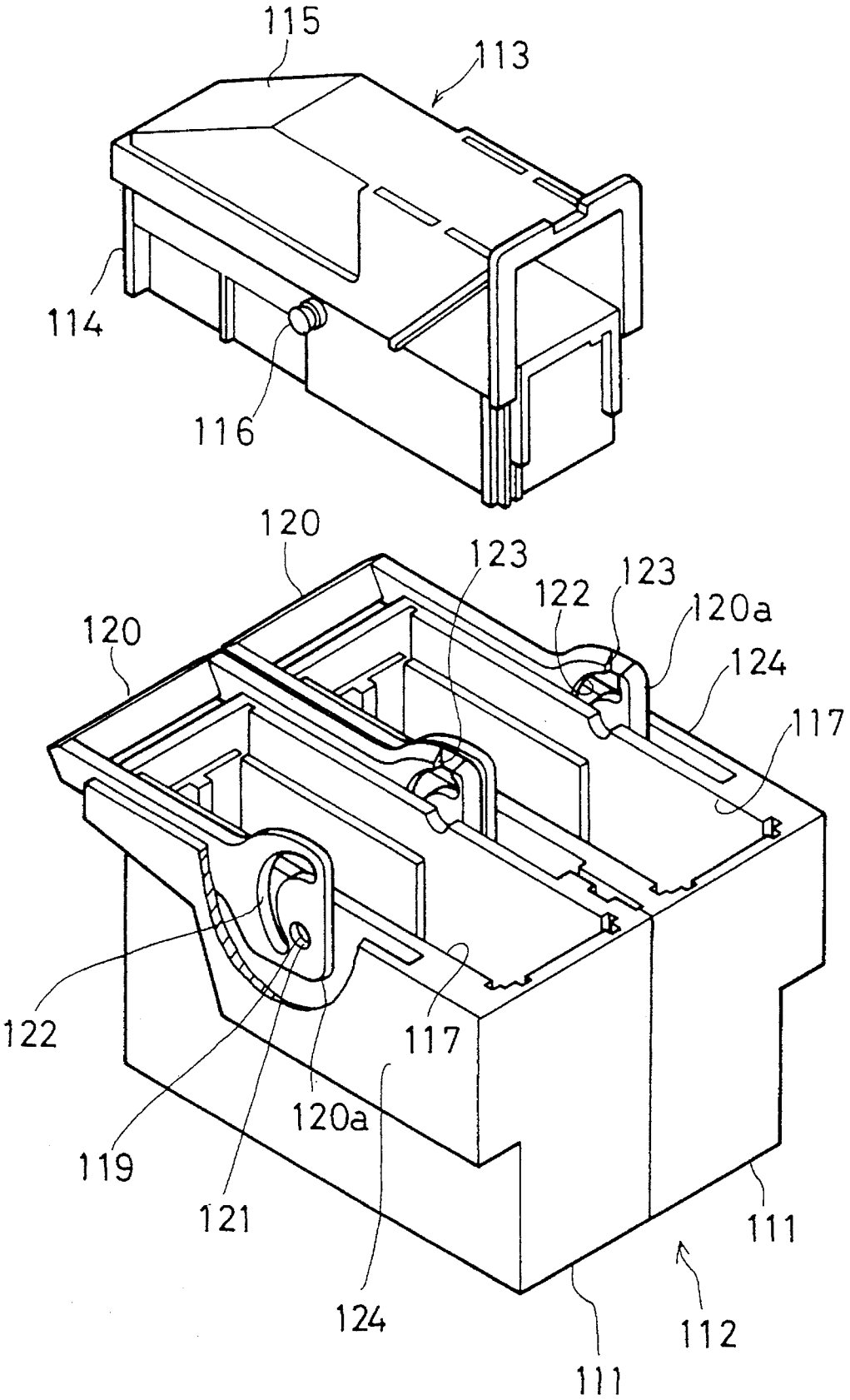
FIG. 1 is an exploded perspective view of a first embodiment of a twin lever connector assembly in accordance with the present invention.

A first embodiment of the present invention will be described with reference to FIGS. 1 to 7. In the embodiment, a multiple lever connector assembly is formed into a twin type including a male connector block 112 comprising two male connector housings 111 coupled to each other so that they are arranged side by side, as shown in FIG. 1. The male connector housings 111 are to be mated with female connectors 113 respectively.

Each female connector 113 includes a female connector housing 114 formed into the shape of a rectangular parallelepiped and accommodating a number of female terminals (not shown) therein, as is well known in the art. A cover 115 is integrally provided on the top of the female connector housing 114. Two cam projections 116 coaxially project from central right-hand and left-hand side walls of the female connector housing 114 respectively.

The male connector block 112 comprises two male connector housings 111 coupled to each other so that they are arranged side by side, as described above. Each male connector housing 111 includes a square female connector accommodating chamber 117 capable of accommodating the female connector housing 114 therein. A number of male terminal accommodating cavities 118 are defined beneath the female connector accommodating chamber 117. The distal ends of male terminals (not shown) disposed in a row in the respective cavities 118 are to extend into the female connector accommodating chamber 117.

Figure 3:
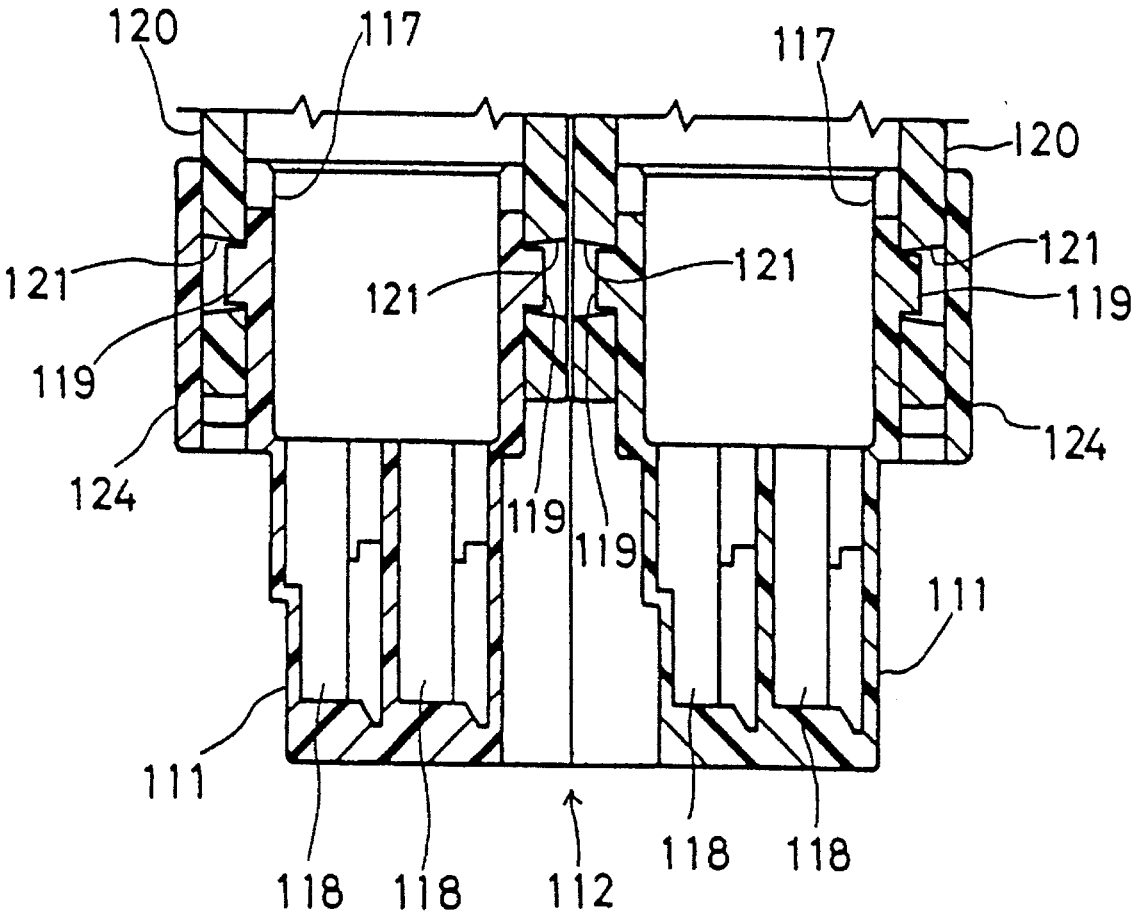
FIG. 3 is a longitudinal sectional view of the male connector block.

Two lever support shafts 119 project from the right-hand and left-hand side walls of each male connector housing 111 respectively. A two-legged operating lever 120 has two bearing holes 121 formed in legs **120*a* thereof respectively. The lever support shafts 119 are fitted into the bearing holes 121 respectively so that the operating lever 120 is rotatably mounted on the male connector housing 111 so as to straddle the same, as shown in FIG. 3. Each leg 120*a* has an arced cam groove 122 formed about the bearing hole 121 and an insertion groove 123 extending from the right-hand edge of the inner face thereof to the right-hand end of the cam groove 122. The cam projections 116 of the female connector housing 114 are inserted through the insertion grooves 123 into the cam grooves 122**, thereby engaging them, respectively.

The male connector block 112 has two outer walls 124 integrally formed on the right-hand and left-hand side walls thereof. One of the legs **120*a* of one operating lever 120 is held between one of the outer wall 124 and the right-hand side wall of one male connector housing 111 while one of the legs 120*a* of the other operating lever 120 is held between the other outer wall 124 and the left-hand side wall of the other male connector housing 111. Accordingly, the width of a space between the outer walls 124 and the side walls of the male connector housings respectively are set so as to be equal to or slightly larger than the thickness of each leg 120*a* of the operating lever 120**.

Figure 2:
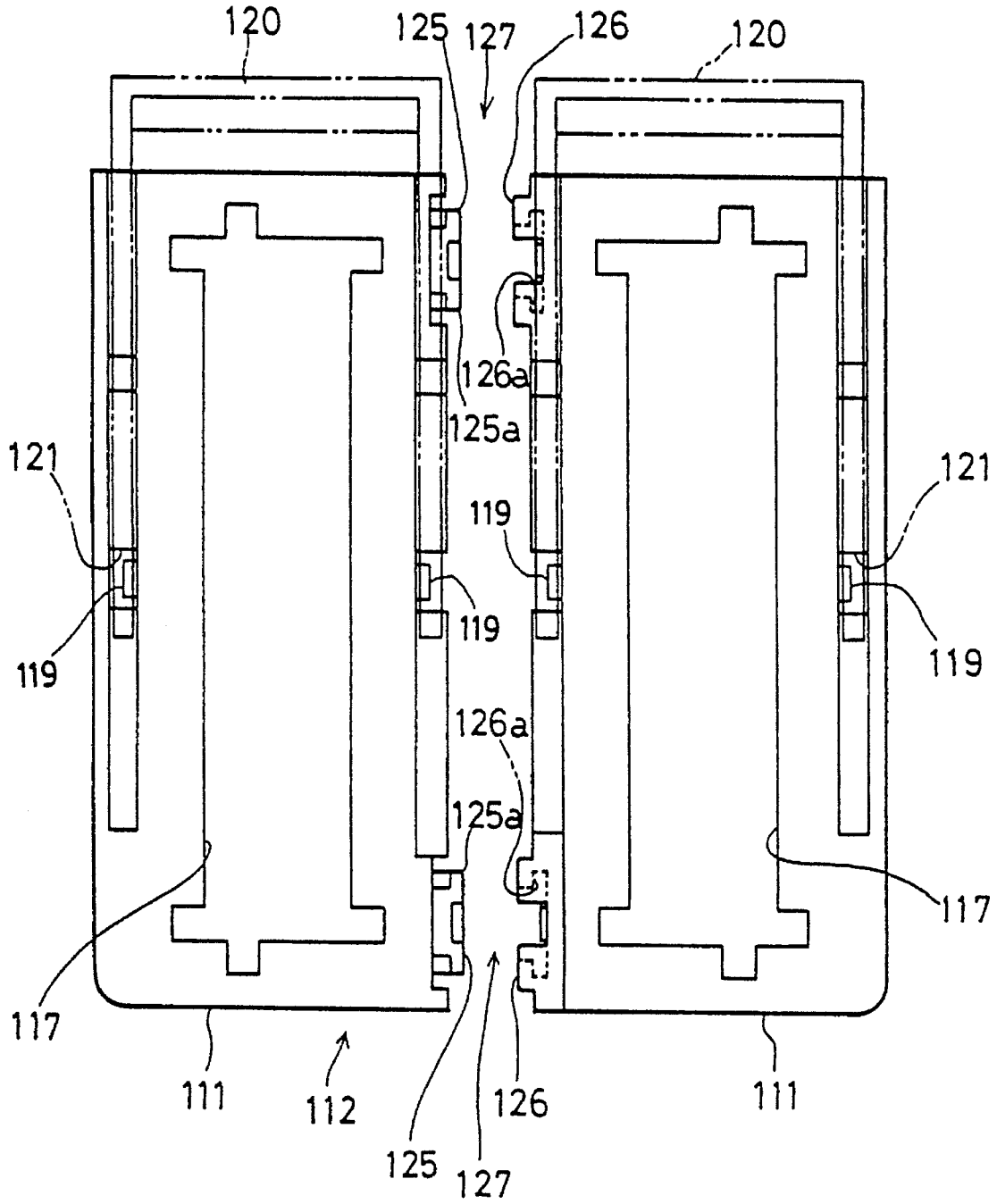
FIG. 2 is a plan view of a male connector block of the twin lever connector assembly.
Figure 4:
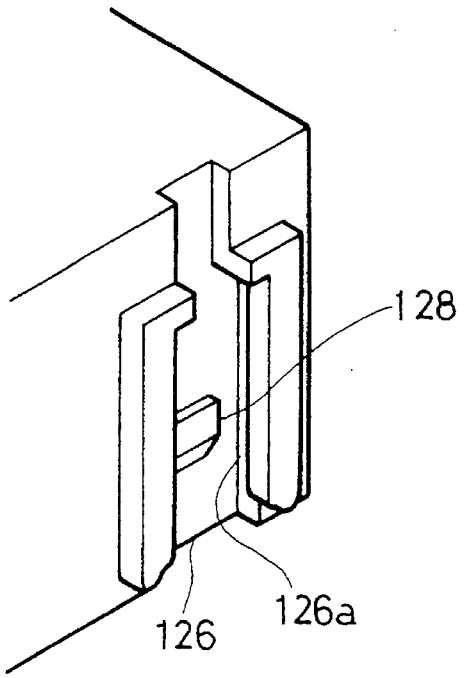
FIG. 4 is a perspective view of an engaged portion formed in each male connector housing of the twin lever connector assembly.

Referring to FIG. 2, the left-hand male connector housing 111 has two engaging sections 125 integrally formed in the front and rear portions of the side wall thereof opposite to the other male connector housing 111. The right-hand male connector housing 111 has two engaged sections 126 integrally formed in the front and rear portions of the side wall thereof opposite to the other male connector housing 111. These two pairs of engaging and engaged sections 125 and 126 constitute two coupling members 127 coupling the male connector housings 111 together. As shown in FIG. 4, the engaged section 126 includes an engagement groove **126*a* formed by expanding and then inwardly bending opposite side edges of a concave portion formed in the side wall of the male connector housing 111. The engaged section 126 further includes a latch claw 128** projecting from the central concave portion.

Figure 5:
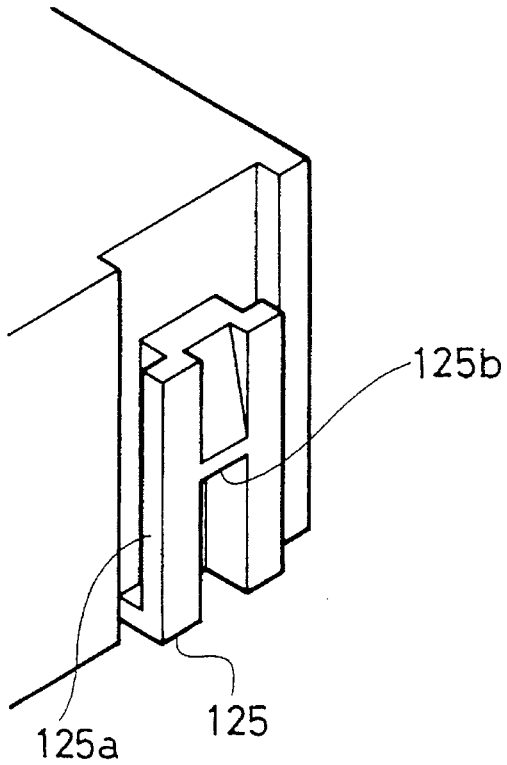
FIG. 5 is a perspective view of an engaging portion formed in each male connector housing of the twin lever connector assembly.
Figure 6:
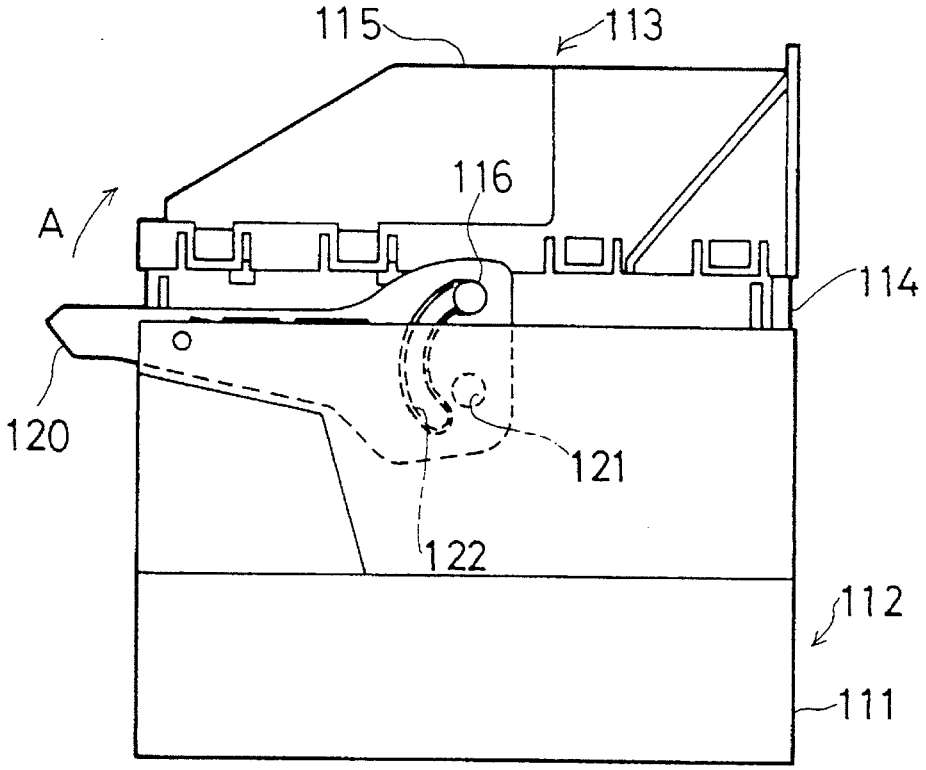
FIG. 6 is a side view of the twin lever connector, showing an initial stage of the mating of male and female connectors.

The engaging sections 125 project so as to be opposite to the engaged sections 126 respectively. As shown in FIG. 5, the right-hand and left-hand edges of the projecting face of the engaging section 125 are further projected, thereby serving as engaging projections **125*a*. The engaging projections 125*a* of each engaging section 125 are engageable with the engagement groove 126*a* of each engaged section 126. The central portion of the upper half of the engaging section 125 is notched obliquely while the lower half thereof is notched to the face of the side wall of the male connector housing 111, thereby serving as a latch hole 125*b*. The latch claw 128 of each engaged section 126 is engaged with the latch hole 125*b* of each engaging section 125. The projected portion of each engaging section 125 and the projected port ion of each engaged section 126 are dimensioned so that clearance between the adjacent faces of the operating levers is smaller than an allowance for the engagement between the lever support shaft 119 and the bearing hole 121**.

The mounting of the operating lever 120 on the male connector housing 111 will now be described. First, when the operating lever 120 is mounted on the right-hand male connector housing 111, the legs 120*a* of lever 120 are applied to the respective side walls of the male connector housing 111 so that the lever 120 straddles it. The lower ends of the legs 120*a* are pushed against the respective lever support shafts 119. Then, when the lever 120 is forced down, the legs 120*a* are flexed such that they are expanded by the respective lever support shafts 119. When the legs 120*a* are further forced down, the lever support shafts 119 are fitted into the respective bearing holes 121, whereupon the lever 120 is rotatably mounted on the male connector housing 111. In the above-described process of mounting, the left-hand leg 120*a* of the operating lever 120 is flexed without restraint. However, since the right-hand leg 120*a* collides with the inner face of the outer wall 124 of the male connector housing 111, the leg is flexed outwardly, against the inner face of the wall 124.

The other operating lever 120 is then mounted on the left-hand male connector housing 111 in the same manner as described above. Then, the male connector housings 111 are aligned, and the distal ends of the engaging projections 125*a* of the left-hand male connector housing 111 are pushed against the engagement grooves 126*a* of the right-hand male connector housing 111, as shown in FIG. 2. The left-hand male connector housing 111 is displaced upwardly relative to the right-hand male connector housing 111 with the engaging projections 125*a* being engaged with the engagement grooves 126*a*, so that the latch claws 128 o f the right-hand connector housing 111 are engaged with the latch holes 125*b* of the left-hand male connector housing 111 respectively. The two male connector housings 111 are thus coupled to each other side by side. The width of the space between the adjacent faces of the operating levers 120 is smaller than the allowance for the engagement between the lever support shaft 119 and the bearing hole 120.

Figure 7:
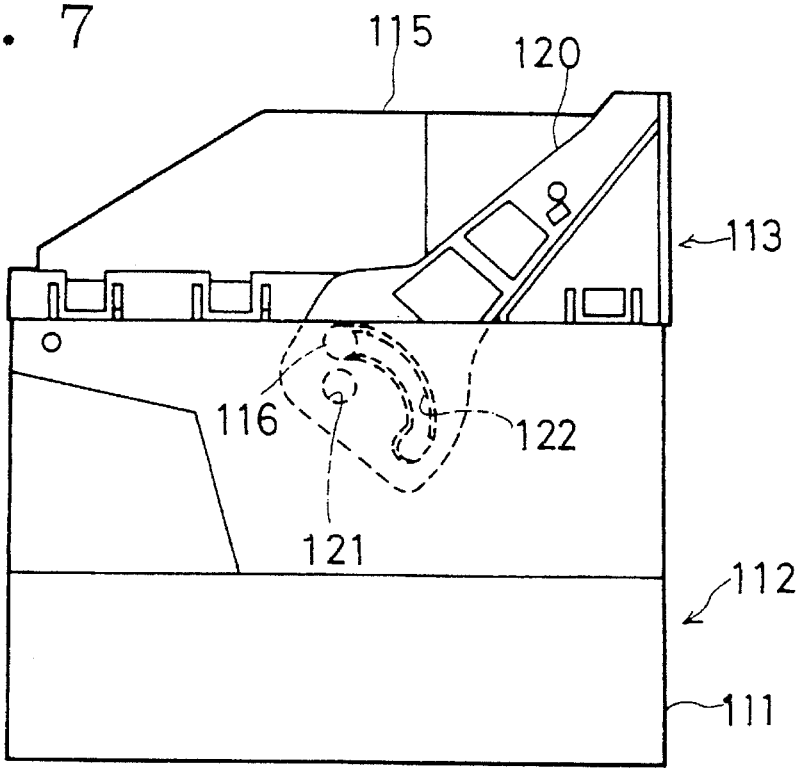
FIG. 7 is a side view of the twin ever connector assembly, showing the state of completion of the mating of the male and female connectors.

The mating of the male and female connector housings 111 and 114 will now be described. The female connector housings 114 are inserted into the accommodating chambers 117 of the male connector housings 111 from the top thereof. The cam projections 116 of each female connector housing 114 are guided by the respective insertion grooves 123 downwardly, engaging the respective cam grooves 122. In this state, when the operating lever 120 is rotated upwardly or in the direction of arrow A in FIG. 6, the cam projection 116 is forced downwardly by the cam action between the same and the cam groove 122, whereupon the female connector housing 114 is displaced into mating engagement with the male connector housing 111 as shown in FIG. 7.

When the male and female connector housings 111 and 114 are mated together, a downward force acts on the operating lever 120 such that the lower ends of the lever 120 are expanded to be thereby displaced in such a direction that the bearing holes 121 are disengaged from the lever support shafts 119. In the embodiment, however, the width of the space between the adjacent faces of the operating levers 120 is smaller than the allowance for the engagement between the lever support shaft 119 and the bearing hole 120. Consequently, since the movement of the operating lever 120 is restricted by the side face of the adjacent operating lever 120, it can be prevented from disengaging of the male connector housing 111.

According to the above-described embodiment, the side face of each operating lever 120 adjacent to that of the other operating lever 120 restricts the movement of the other operating lever 120 in such a direction that the bearing holes 121 are disengaged from the respective lever support shafts 119. Consequently, the outer wall employed in the conventional in the construction need not be provided between the adjacent male connector housings for restricting the movement of each male connector housing, which allows the connector to be made smaller in size.

In the foregoing embodiment, each coupling member 127 comprises the engaging section 125 and the engaged section 126 engaged with the engaging section 125 so that the male connector housings 111 are coupled together. However, the manner of coupling should not be limited to this.

Figure 8:
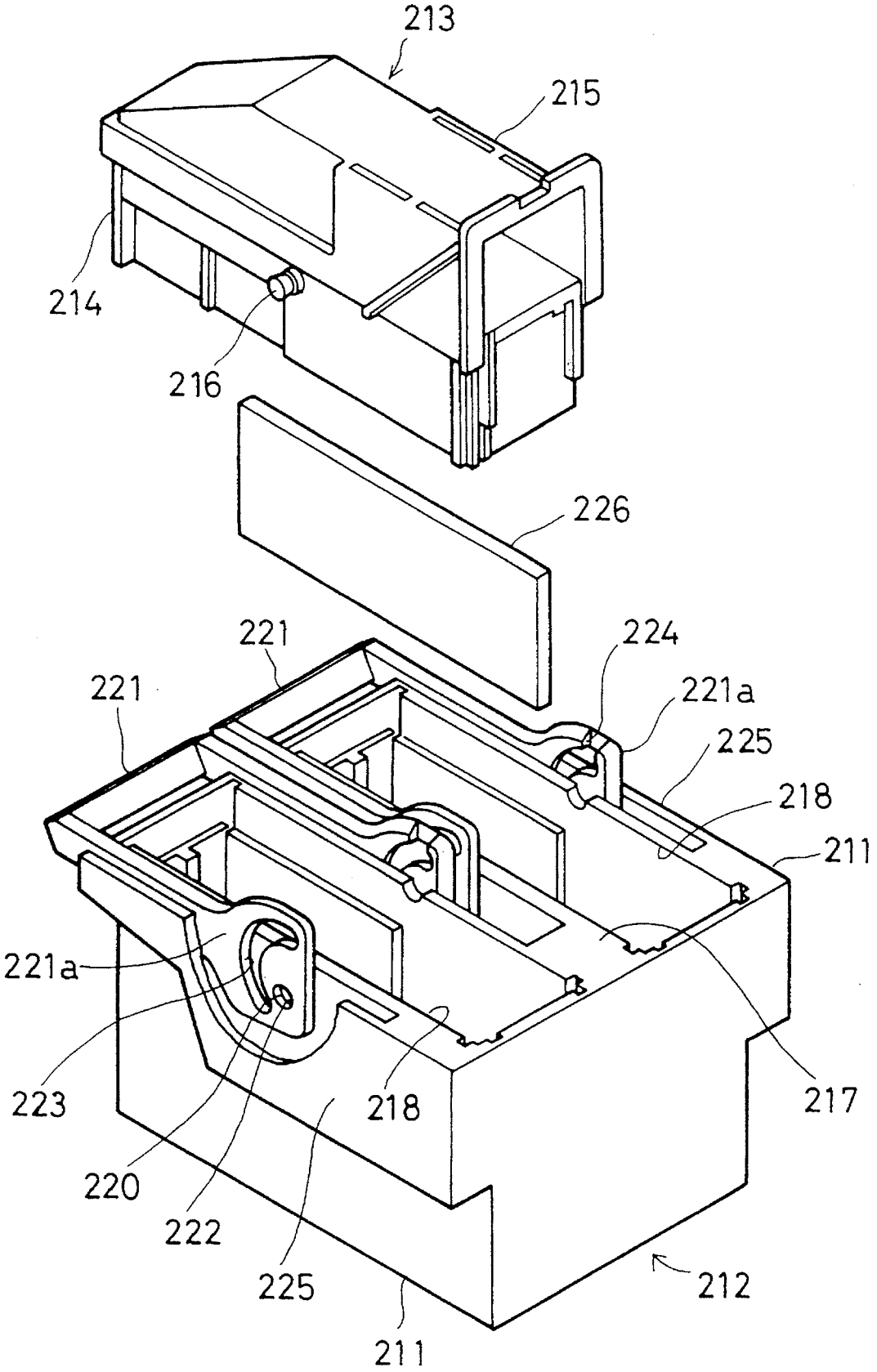
FIG. 8 is an exploded perspective view of a second embodiment of a twin lever connector assembly in accordance with the present invention.
Figure 9:
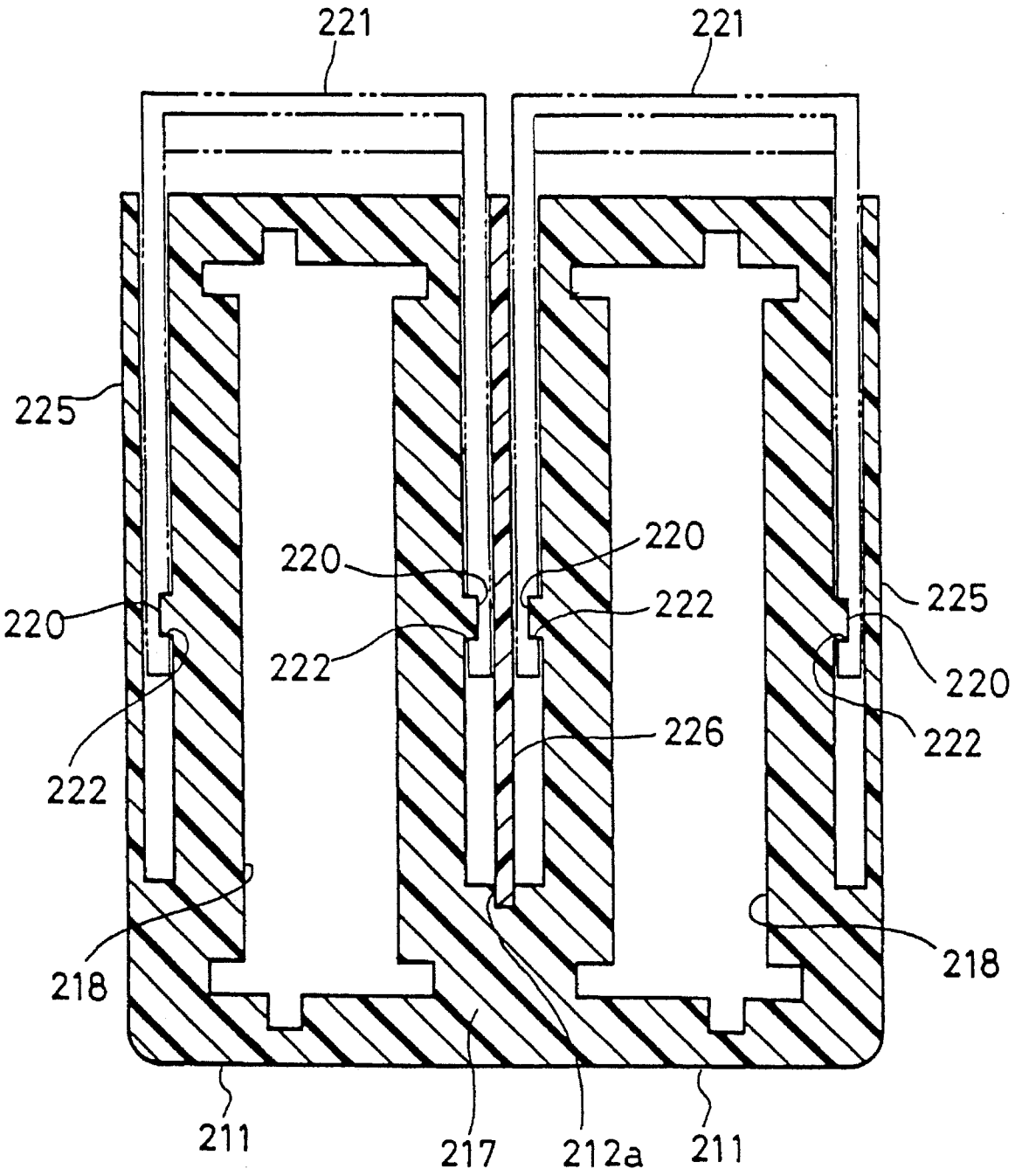
FIG. 9 is a transverse sectional view of the male connector block.
Figure 10:
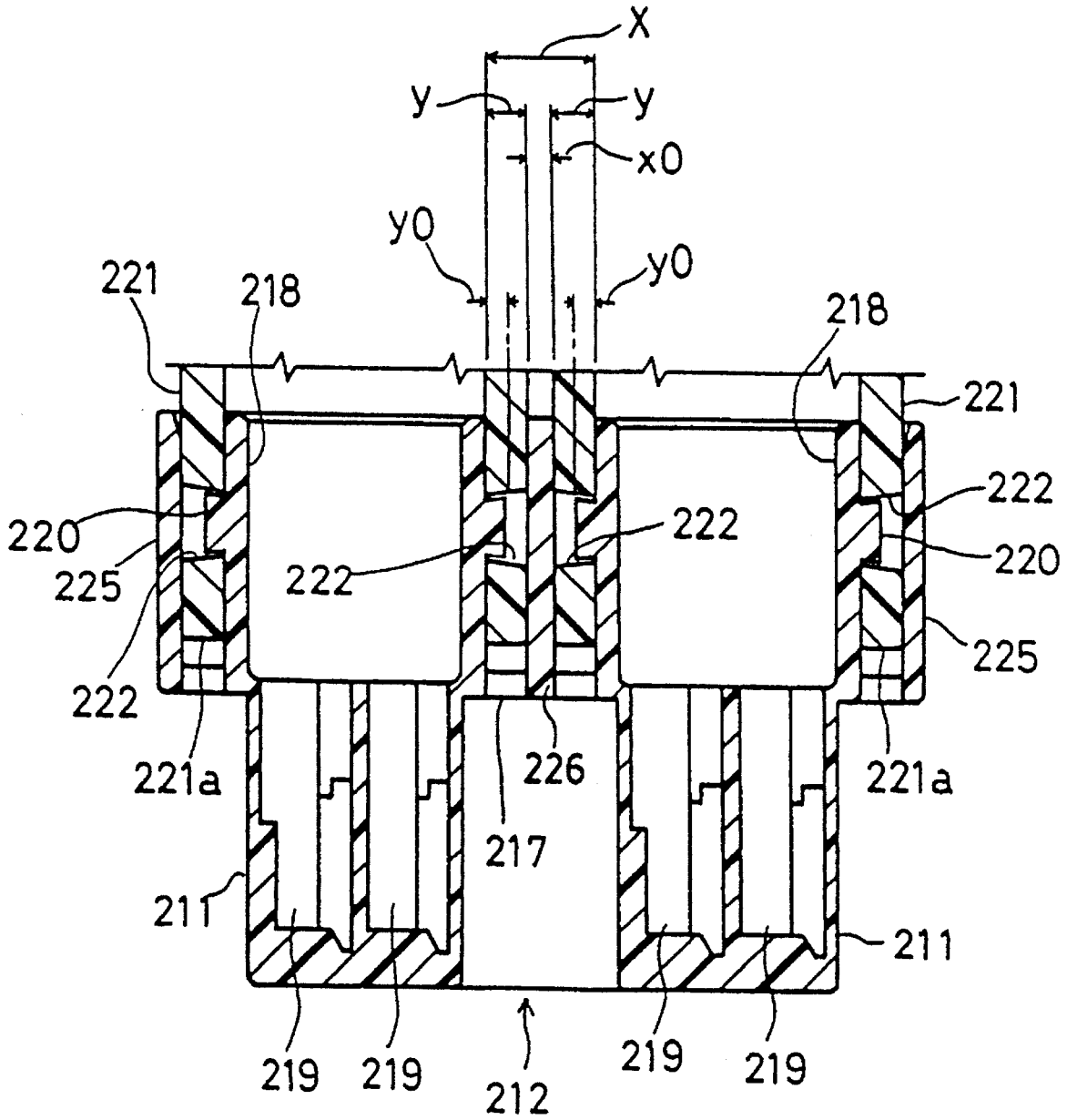
FIG. 10 is a longitudinal sectional view of the male connector block.

FIGS. 8 to 10 illustrate a second embodiment of the present invention. In the second embodiment, a multiple lever connector is formed into a twin type including a male connector block 212 comprising two male connector housings 211 coupled to each other so as to be arranged side by side, as shown in FIG. 8. The male connector housings 211 are to be mated with female connectors 213 respectively.

Each female connector 213 includes a female connector housing 214 formed into the shape of a rectangular parallelepiped and accommodating a number of female terminals therein, as is well known in the art. A cover 215 is integrally provided on the top of the female connector housing 214. Two cam projections 216 coaxially project from central right-hand and left-hand side walls of the female connector housing 214 respectively.

The male connector block 212 comprises two male connector housings 211 coupled at a coupling portion 217 to each other so that they are arranged side by side, as described above. Each male connector housing 211 includes a square female connector accommodating chamber 218 capable of accommodating the female connector housing 214 therein. A number of male terminal accommodating cavities 219 are defined beneath the female connector accommodating chamber 218. The distal ends of male terminals (not shown) disposed in a row in the respective cavities 219 are to project into the female connector accommodating chamber 218. The coupling portion 217 couples the male connector housings 211 at the back (the lower portion in FIG. 9) and the bottom (the lower portion in FIG. 10) of the male connector block 212. The upper and front portions of the coupling portion 217 are open.

Two lever support shafts 220 project from the right-hand and left-hand side walls of each male connector housing 211 respectively. A two-legged operating lever 221 has two bearing holes 222 formed in legs 221*a*. The lever support shafts 220 are fitted into the bearing holes 222 respectively so that the operating lever 221 is rotatably mounted on the male connector housing 211 so as to straddle the same, as shown in FIG. 10. Each leg 221*a* has an arced cam groove 223 formed about the bearing hole 222 and an insertion groove 224 extending from the right-hand edge of the inner face thereof to the right-hand end of the cam groove 223. The cam projections 216 of the female connector housing 214 are inserted through the insertion grooves 224 into the cam grooves 223.

The male connector block 212 has two outer walls 225 integrally formed on the right-hand and left-hand side walls thereof. One of the legs 221*a* of one operating lever 221 is held between one of the outer wall 225 and the right-hand side wall of one male connector housing 211 while one of the legs 221*a* of the other operating lever 221 is held between the other outer wall 225 and the left-hand side wall of the other male connector housing 211. Accordingly, the width of a space between the outer wall 225 and the side wall of the male connector housing 211 is set so as to be equal to or slightly larger than the thickness of each leg 221*a* of the operating lever 221.

As best shown in FIG. 10, the right-hand side wall of the left-hand male connector housing 211 and the left-hand side wall of the right-hand male connector housing 211 are provided with no such outer wall as described above and accordingly, these walls are opposite to each other. The width X of a space between the walls are set so that a space larger than the allowance for the engagement between the lever support shaft 220 and the bearing hole 222 is defined between the operating levers 221 when they have been mounted on the respective male connector housings 211. More specifically, the width X is set so as to satisfy the following expression:

$$X=2y+x_0 \quad x_0>y_0$$

where y is the thickness of each leg 221*a* of the operating lever 221, $x_0$ is the width of a space between the operating levers mounted on the respective male connector housings 211, and $y_0$ is the allowance for engagement between the lever support shaft 220 and the bearing hole 222.

A holding groove 212*a* is formed in a part of the coupling portion 217 of the male connector block 212, the part corresponding to the space between the operating levers 221. A restricting plate 226 is detachably forced into the holding groove 212*a*. The thickness of the restricting plate 226 is set so as to be slightly smaller than the space $x_0$ between the operating levers 221 mounted on the respective male connector housings 211. The leg 221*a* of each operating lever 221, when flexed, comes into contact with the restricting plate 226. Consequently, the amount of flexure of the operating lever 221 is restricted to the value smaller than the allowance $y_0$ for the engagement between the lever support shaft 220 and the bearing hole 222.

The mounting of the operating lever 221 on the male connector housing 211 will now be described. First, when the operating lever 221 is mounted on the right-hand male connector housing 211, the legs 221*a*, of lever 221 are applied to the side walls of the male connector housing 211 so that the lever 221 straddles it. The lower ends of the legs 221*a* are pushed against the respective lever support shafts 220. The legs 221*a* are flexed such that they are expanded by the lever support shafts 220. When the legs 221*a* are further forced down, the lever support shafts 220 are fitted into the respective bearing holes 222, whereupon the lever 221 is rotatably mounted on the male connector housing 211. In the above-described process of mounting, the left-hand leg 221*a* of the operating lever 221 is flexed without restraint. However, since the right-hand leg 221*a* collides with the inner face of the outer wall 225 of the male connector housing 211, it is flexed outwardly, against the inner face of the wall.

The other operating lever 221 is then mounted on the left-hand male connector housing 211 in the same manner as described above. Thereafter, the mounting of the operating levers 221 is completed when the restricting plate 226 is forced into the holding groove 212*a* formed in the coupling portion 217 of the male connector block 212. The right-hand leg 221*a* of the second operating lever 221 is flexed outwardly when it is mounted on the left-hand male connector housing 211. However, the space $x_0$ between the operating levers 221 mounted on the respective male connector housings 211 is set to be larger than the allowance $Y_0$ for the engagement between the lever support shaft 220 and the bearing hole 222. Consequently, the required flexure of the operating lever 221 is allowed, so that the lever support shaft 220 is fitted into the bearing hole 222.

If sufficient force acts on each operating lever 221 during its rotative movement, the leg 221*a* collides with the restricting plate 226, which prevents further deformation of the lever 221. Thus, the lever 221 can be reliably prevented from flexing to such an extent that it is disengaged from the lever support shaft 220 and accordingly, the lever 221 can be prevented from disengaging the male connector housing 211.

To detach the lever 221 from the male connector housing 211 for replacement, the restricting plate 226 is removed from groove 212*a* and the legs 221*a* of the lever 221 are flexed and the lever support shafts 220 are drawn out of the respective bearing holes 222.

According to the above-described embodiment, the restricting plate 226 is forced into the holding groove 212*a* between the male connector housings 211 to restrict the flexure of the lever 221 after the levers 221 have been mounted on the respective male connector housings 211. Differing from the prior art, the above-described construction does not necessitate provision of the outer walls on the left-hand, or interior side of one connector housing and the right-hand or interior side of the other connector housing. Two outer walls can be eliminated and the lateral dimension of the male connector block 212 can be reduced accordingly. Furthermore, since the restricting plate 226 restricting the flexure of each lever 221 is detachable, the lever 221 can be replaced by a new one as needed. Alternatively, the restricting plate 226 may be undetachably mounted in the holding groove 212*a*, for example, by an adhesive.

Although the restricting plate 226 is forced into the holding groove 212*a* to be held in position in the foregoing embodiment, it may be inserted into the space between the mate connector housings 211 so that the rotative movement of the lever 221 is allowed.

Although the cam projections 216 are formed on the housing 214 of each female connector 213 in the foregoing embodiment, they may alternatively project from the cover 215 of each female connector 213. Furthermore, the male and female terminals may be disposed in the reversed relation to that described above.

Figure 11:
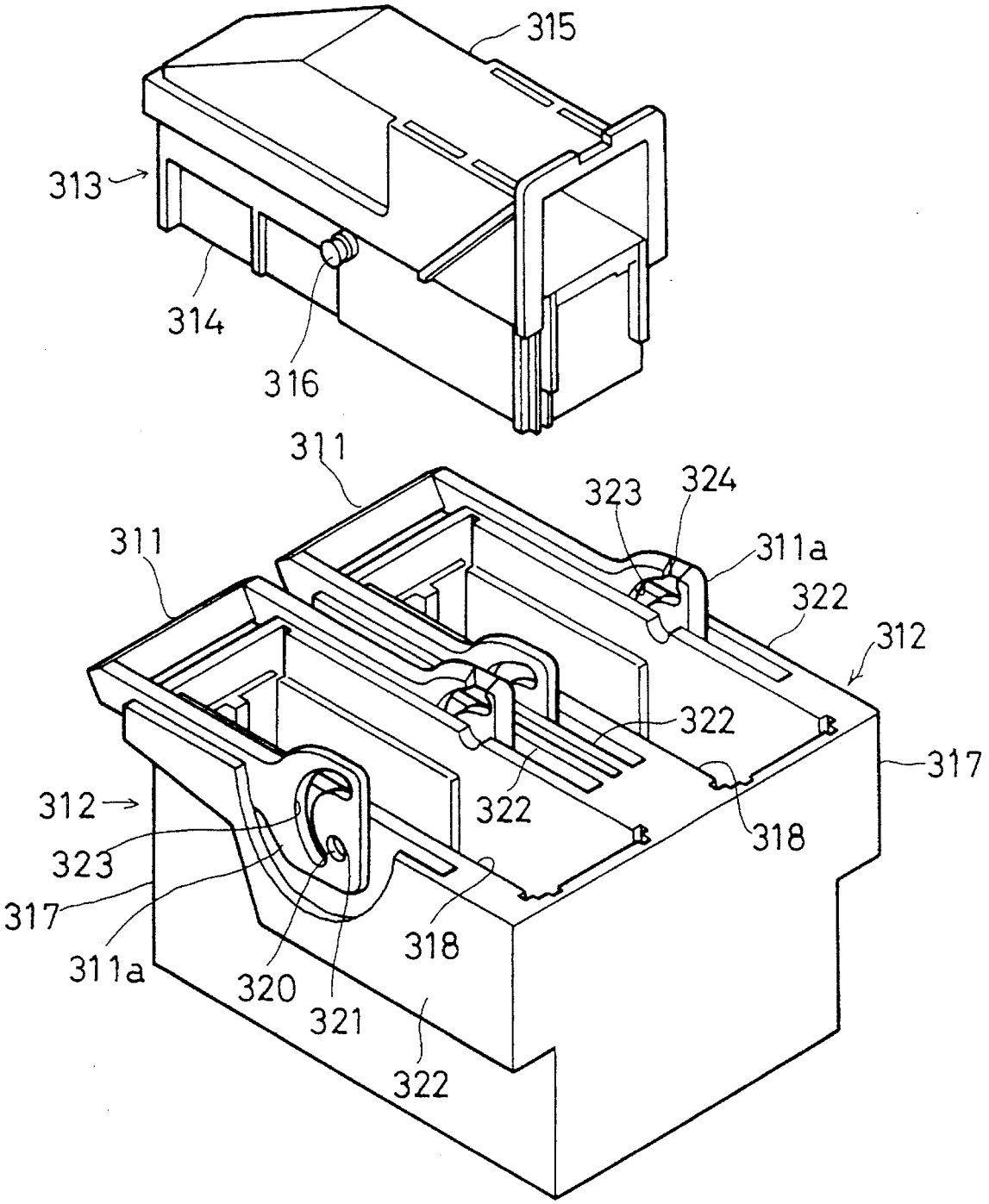
FIG. 11 is an exploded perspective view of a third embodiment of a twin lever connector assembly in accordance with the present invention.
Figure 12:
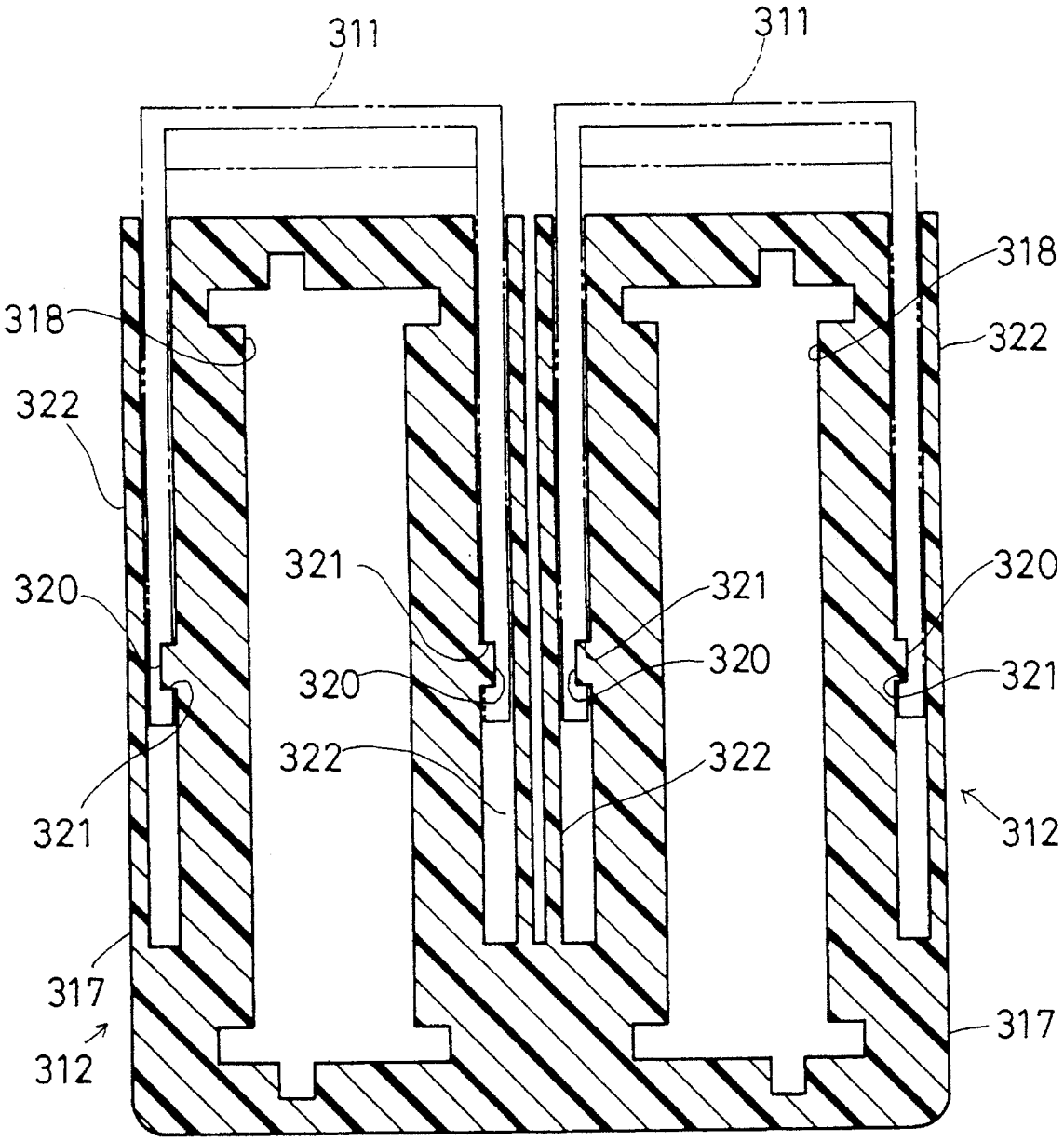
FIG. 12 is a transverse sectional view of the male connector block.
Figure 13:
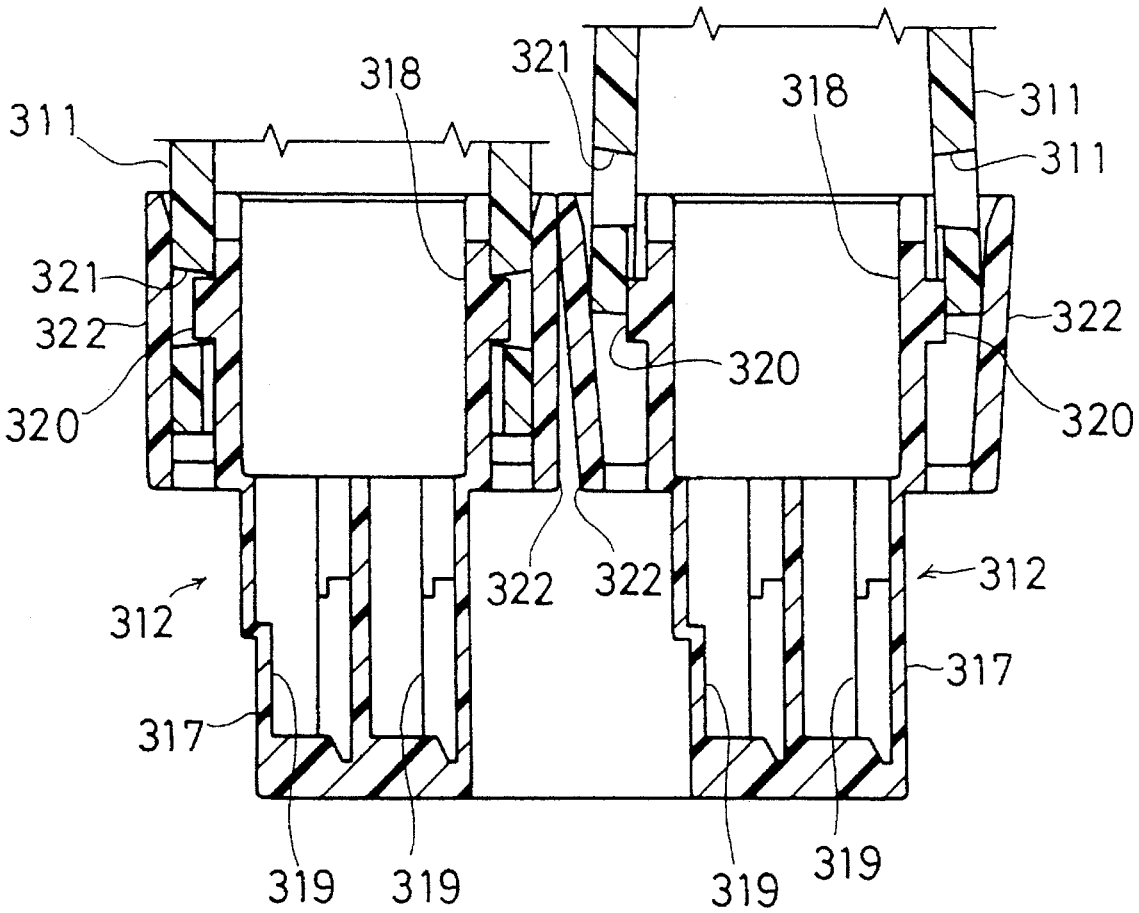
FIG. 13 is a longitudinal sectional view of a twin lever connector assembly, showing the mounting of an operating lever.

FIGS. 11 to 18 illustrate a third embodiment of the invention. In the third embodiment, the multiple lever connector assembly is formed into a twin type including two male connectors 312 having respective operating levers 311 and coupled to each other so that they are arranged side by side, as shown in FIG. 11. The male connectors 312 are to be mated with female connectors 313. Since the male connectors 312 have the same construction, one of them will be described.

Each female connector 313 includes a female connector housing 314 formed into the shape of a rectangular parallelepiped and accommodating a number of female terminals therein, as is well known in the art. A cover 315 is integrally provided on the top of the female connector housing 314. Two cam projections 316 coaxially project from central right-hand and left-hand side walls of the female connector housing 314.

The male connector 312 includes a male connector housing 317 formed into the shape of a rectangular parallelepiped and a square female connector accommodating chamber 318 capable of accommodating the female connector housing 314 therein. A number of male terminal accommodating cavities 319 are defined beneath the female connector accommodating chamber 318. The distal ends of male terminals (not shown) disposed in a row in the respective cavities 319 are to project into the female connector accommodating chamber 318.

Figure 14:
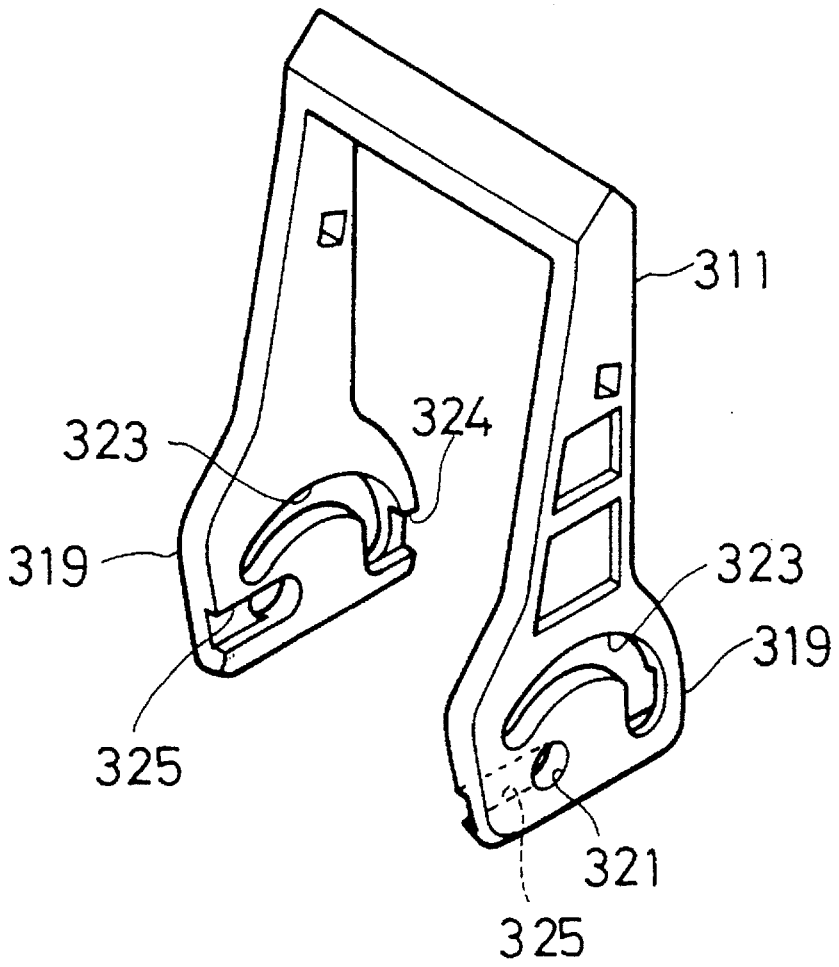
FIG. 14 is a perspective view of the operating lever.
Figure 15:
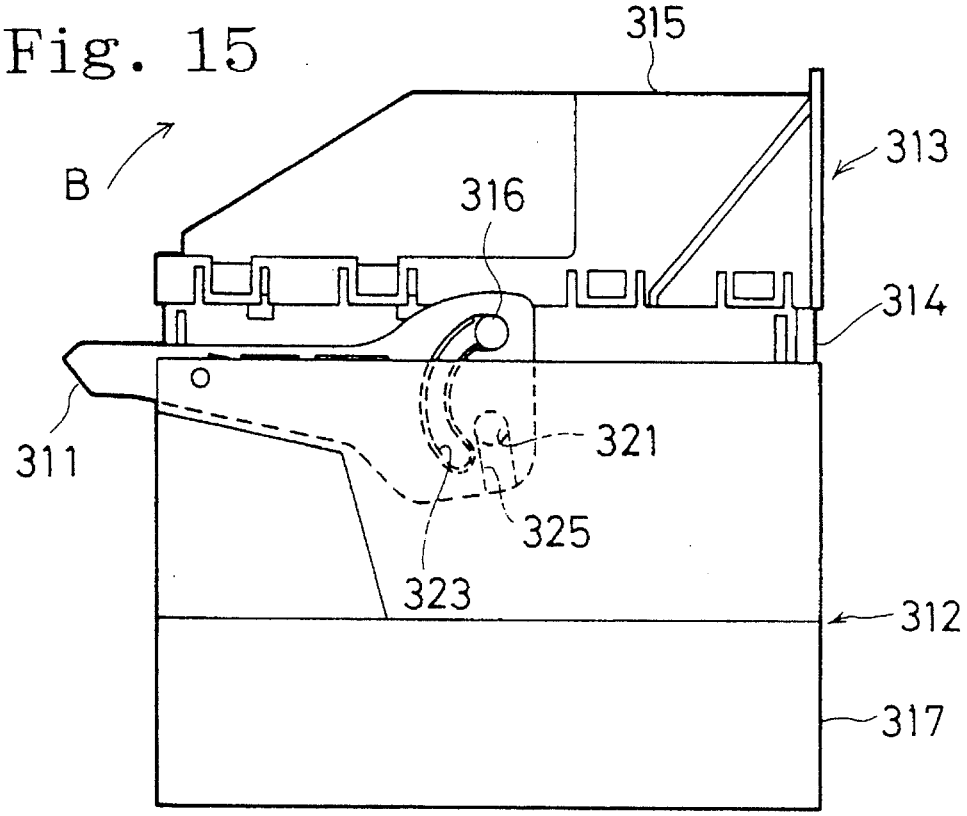
FIG. 15 is a side view of the twin lever connector assembly of the third embodiment, showing an initial stage of the mating of male and female connectors.

Two lever support shafts 320 coaxially project from the outer faces of the right-hand and left-hand side walls of each female connector accommodating chamber 318 of the male connector housing 317. The length of projection of each lever support shaft 320 is set to be about 1.5 mm. A two-legged operating lever 311 has two bearing holes 321 formed in legs 311*a* as shown in FIG. 14. The lever support shafts 320 are fitted into the bearing holes 321 so that the operating lever 311 straddles and is rotatably mounted on the male connector housing 317. Each male connector housing 317 has two outer walls 322 integrally formed on the right-hand and left-hand side walls thereof. The legs 311*a* of the lever 311 are inserted between the right-hand and left-hand side walls of the male connector housing 317 and the outer walls 322 respectively. The width of a space between the outer walls 322 and the side walls of the male connector housings 317 respectively are set so as to be equal to or slightly larger than the thickness of each leg 311*a* of the operating lever 311.

Each leg 311*a* has an arced cam groove 323 formed about the bearing hole 321 and an insertion groove 324 extending from the right-hand edge of the inner face thereof to the right-hand end of the cam groove 323. The cam projections 316 of the cover 315 provided on the female connector housing 314 are inserted through the insertion grooves 324 into the cam grooves 323.

Each leg 311*a* of the operating lever 311 has a projection accommodating groove 325 recessed in the inner face thereof and extending from the left-hand edge thereof to the bearing hole 321. The groove 325 has such a width that the lever support shaft 320 is allowed to enter the same. The depth of the groove 325 is set to be about one half of the allowance for engagement between the lever support shaft 320 and the bearing hole 321 or about 1 mm. The groove 325 extends so as to deviate from a line A (FIG. 17) drawn between the cam projection 316 and the lever support shaft 320 in the state where maximum resistance is reached when the lever 311 is rotatively moved for the mating of the male and female connectors 312 and 313, as will be understood in the later description of the operation. More specifically, the groove 325 is formed to extend at an angle of about 60 degrees to line A.

The mounting of the operating lever 311 on the male connector housing 317 will now be described. The operating lever 311 is first disposed to straddle the male connector housing 317 from above. The legs 311*a* of the lever 311 are then inserted into the spaces between the side walls of the male connector housing 317 and the outer walls 322 The edges of the projection accommodating grooves 325 are applied to the respective lever support shafts 320. When the lever 311 is forced down the legs 311*a* are expanded by the lever support shafts 320 against the inner faces of the outer walls 322. Consequently, the outer walls 322 flex outwardly such that the lever support shafts 320 enter the respective projection accommodating grooves 325, as in the right-hand male connector housing 317 in FIG. 13. Thereafter, when the operating lever 311 is finally fitted into the respective bearing holes 321, the lever 311 is rotatably mounted on the male connector housing 317.

In the above-described process of mounting, the outer walls 322 of the male connector housing 317 are flexed by the respective legs 311*a* of the operating lever 311 so as to expand outwardly. Consequently, the lever support shafts 320 are engaged with the respective bearing holes 321 as in the conventional lever connector. However, the operating lever 311 is provided with the projection accommodating grooves 325 formed to extend from the edges of the legs 311*a* of the bearing holes 321. Accordingly, the distal ends of the lever support shafts 320 are located in the projection accommodating grooves 325 until the lever support shafts 320 are fitted into the bearing holes 321. Since each groove 325 is recessed from the inner surface of the leg 311*a*, the thickness of the portion of the leg 311*a* where the groove 325 is formed is reduced as compared with the other portion of the lever 311. Consequently, even though each leg 311*a* of the operating lever 311 is flexed to expand in the same manner as in the prior art, the amount of flexure is about two-thirds of that in the conventional lever connector. Thus, the insertion resistance of the operating lever 311 can be reduced, which improves the assembling efficiency. Furthermore, the reduction in the amount of flexure of each leg 311*a* of the operating lever 311 and each outer wall 322 of the male connector housing 317 can reduce the necessary space between the adjacent outer walls 322 of both male connector housings 317. Consequently, the size of the lever connector assembly can be reduced.

Figure 16:
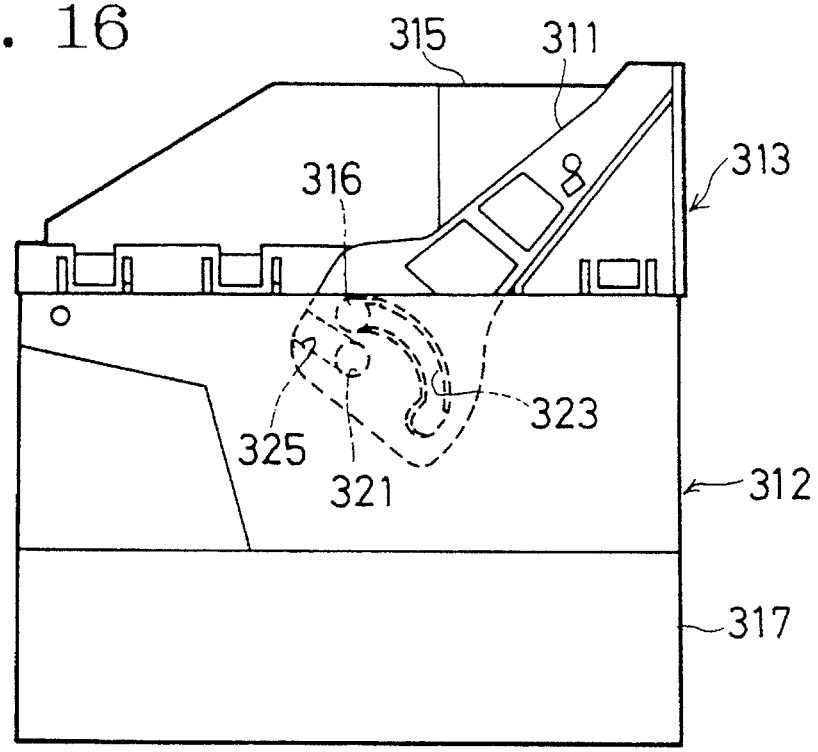
FIG. 16 is a side view of the twin lever connector assembly of the third embodiment, showing the state of completion of the mating of the male and female connectors.
Figure 17:
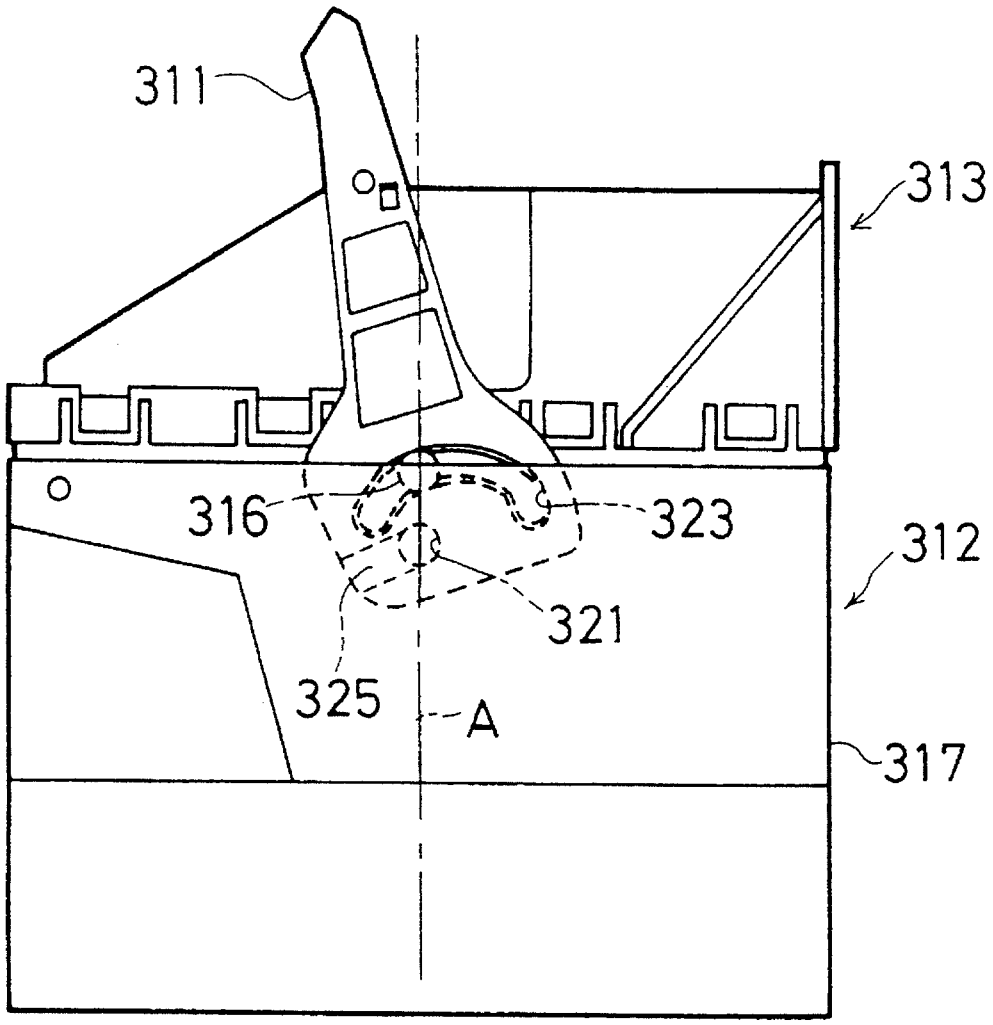
FIG. 17 is a side view of the twin lever connector assembly, showing the location of the operating lever where the maximum resistance thereof is reached when the male and female connectors are mated together.

The mating of the male and female connectors 312 and 313 will now be described. The female connector housing 314 is inserted into the accommodating chamber 318 of the male connector housing 317. The cam projections 316 of each female connector housing 314 are guided downwardly by the respective insertion grooves 324 of the operating lever 311, engaging the respective cam grooves 323. When the operating lever 311 is rotated upwardly or in the direction of arrow B in FIG. 15, the cam projection 316 is forced downwardly by the cam act ion between the projection and the cam groove 323, whereupon the female connector housing 314 is displaced into mating engagement with the male connector housing 317 as shown in FIG. 16.

Figure 18:
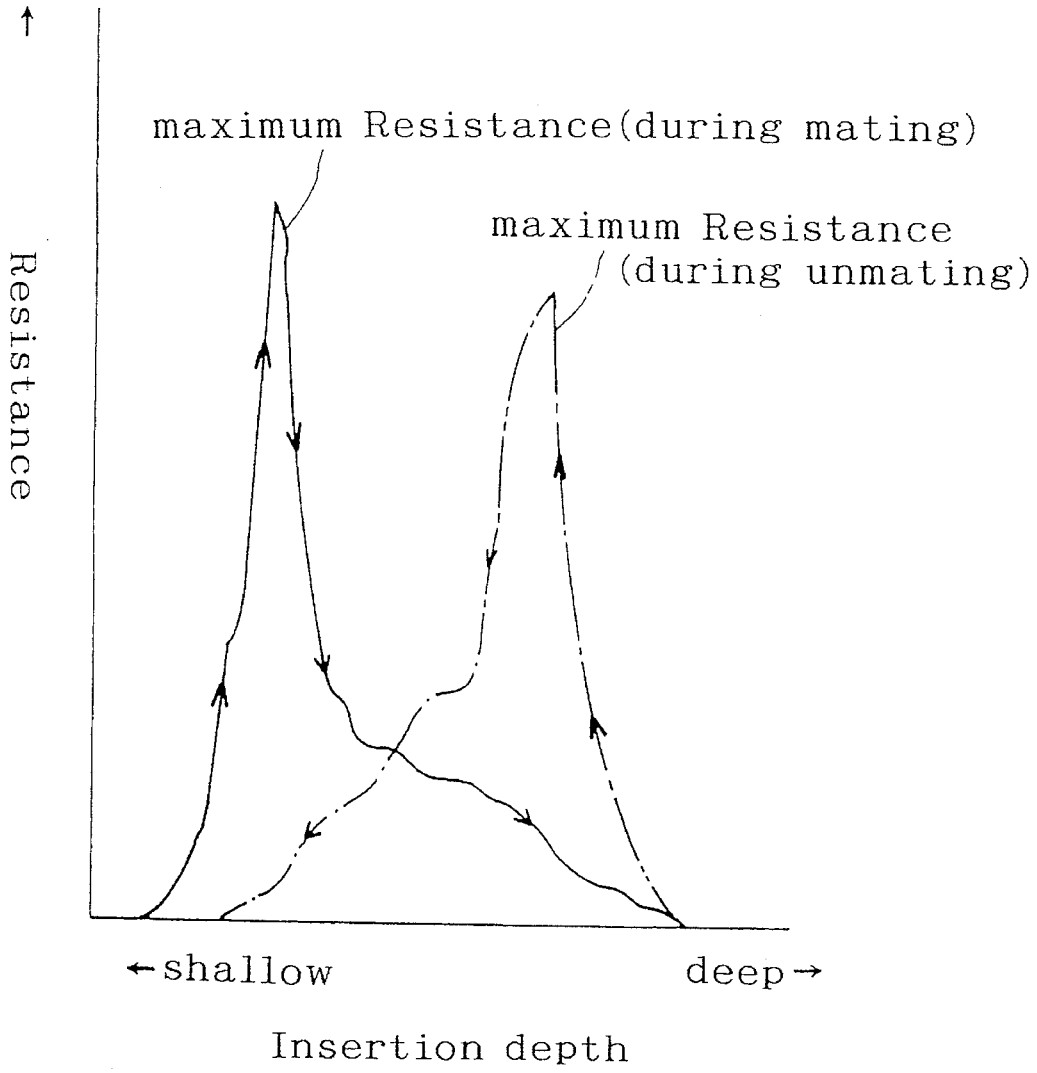
FIG. 18 is a graph showing the change in the insertion resistance.
Figure 19:
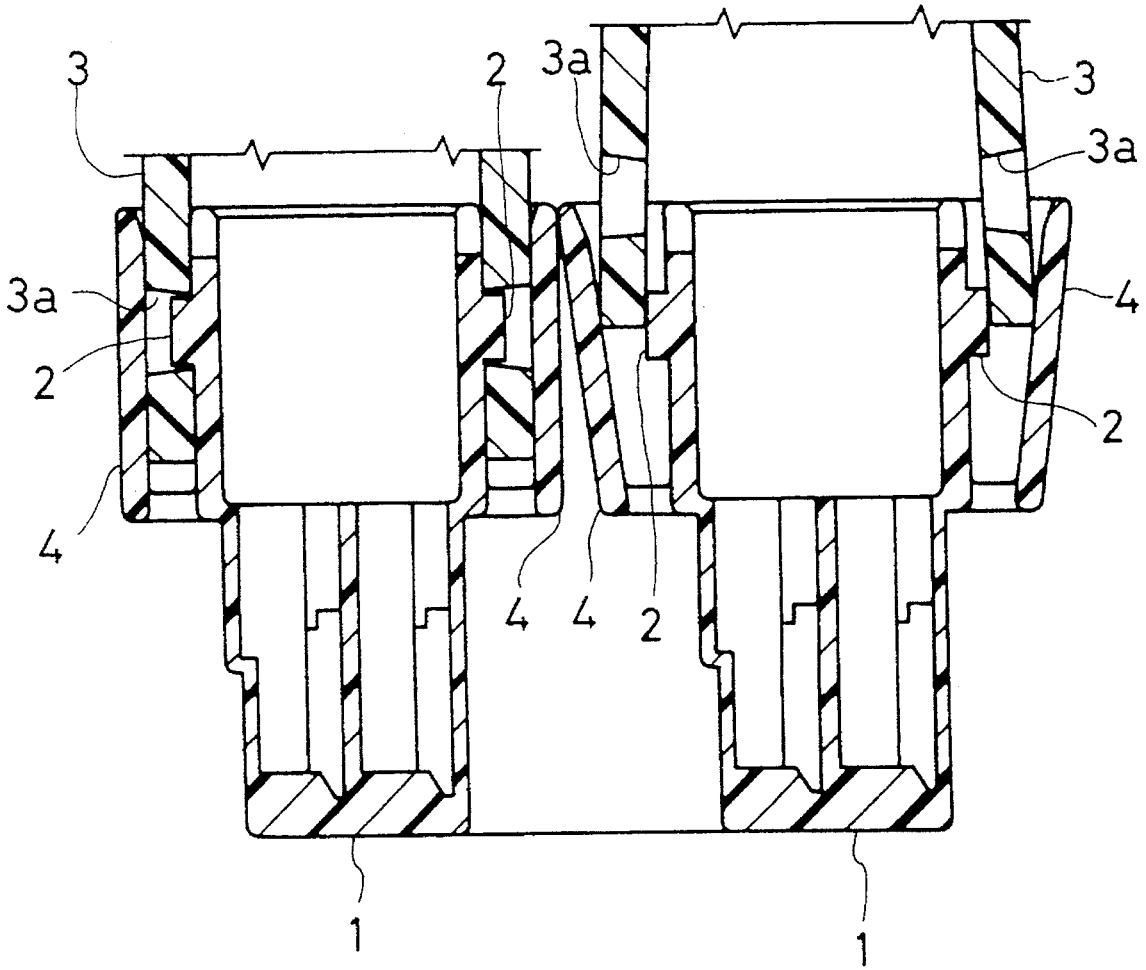
FIG. 19 is a longitudinal sectional view of a conventional twin lever connector assembly, showing the mounting of the operating lever.

When the lever 311 is operated so that the male and female connectors 312 and 313 are mated together, an upper open edge of each cam groove 323 pushes the cam projection 316 downwardly. In this regard, the insertion resistance due to the frictional resistance between each pair of male and female terminals acts on the operating lever 311 so that it is pushed upwardly. The insertion resistance is not uniform during the rotative movement of the lever 311 but varies with the angle of rotative movement. More specifically, the insertion resistance varies as shown in FIG. 18 and the maximum insertion resistance appears in a first half of the rotative movement of the lever 311. The lever 311 is subjected to the largest upward force when rotated to the position where the maximum insertion resistance appears. This pushing force acts on line A between the cam projection 316 and the lever support shaft 320. Accordingly, if the projection accommodating groove 325 is located on line A when the lever 311 has been rotated moved to the position where the maximum insertion resistance appears, each lever support shaft 320 will enter the inside of the projection accommodating groove 325 from the bearing hole 321 when the force pushing the lever 311 upwardly is extremely large. Consequently, each lever support shaft 320 will disengage from the bearing hole 321. In the embodiment, however, the projection accommodating groove 325 is deviated from line A so as to be at the angle of about 60 degrees to line A. Consequently, the operating lever 311 can be prevented from being disengaged from the lever support shafts 320 when the male and female connectors 312 and 313 are mated together.

Although the cam projections 316 are provided on the housing 314 of the female connector 313 in the foregoing embodiment, they may alternatively project from the cover 315 of the female connector 313. Furthermore, the male and female terminals may be disposed in the reversed relation to that described above.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A connector assembly comprising:

a) a plurality of first connector housings forming male terminal accommodating cavities, each said housing having opposite side walls;

b) a plurality of second connector housings forming female terminal accommodating chambers;

c) a lever support shaft protruding outwardly from each of said first connector housing side walls;

d) a plurality of operating levers each straddling one of said first connector housings and each having two bearing holes into which said lever support shafts are fitted for rotatably mounting said operating levers on said first connector housings e) a plurality of cam projections provided on each of said second connector housings and engaging said levers to displace said first and second connector housings by cam action of said operating levers in a coupling direction and in an uncoupling direction; and f) a coupling member coupling said first connector housings to one another so that said first connector housings are arranged side by side with a predetermined clearance between adjacent surfaces of said operating levers, said clearance being smaller than a depth of fit between said lever support shafts and said respective operating lever bearing holes.

2. The connector assembly as claimed in claim 1, wherein said first connector housings, arranged side by side, define an integral connector block; and said first connector housings, located at opposite ends of said connector block, each include an outer wall disposed outside said operating lever and covering said lever support shaft.

3. A connector assembly comprising:

a) a plurality of first connector housings each having opposite side walls forming a male terminal accommodating cavity, said first connector housings being arranged side by side with a clearance between adjacent side walls of said first connector housings;

b) a plurality of second connector housings forming female terminal accommodating chambers;

c) a lever support shaft protruding outwardly from each of said first connector housing side walls;

d) a plurality of operating levers, each straddling one of said first connector housings, each said lever having two bearing holes into which said lever support shafts are fitted for rotatably mounting said operating levers on said first connector housings;

e) a plurality of cam projections provided on said second connector housings engaging said levers to displace said first and second connector housings by cam action of said operating levers in a coupling direction and an uncoupling direction; and f) a restricting member disposed in each said clearance between said adjacent side walls.

4. The connector assembly as claimed in claim 3, wherein said first connector housings, arranged side by side, define an integral connector block; and said first connector housings, located at opposite ends of said connector block, each include an outer wall disposed outside said operating lever and covering said lever support shaft.

5. The connector assembly as claimed in claim 3, wherein said restricting members are detachably disposed in said clearances.

6. The connector assembly as claimed in claim 4, wherein said restricting members are detachably disposed in said clearances.

7. A connector assembly comprising:

a) a plurality of first connector housings each having opposite side walls forming male terminal accommodating cavities;

b) a plurality of second connector housings forming female terminal accommodating chambers;

c) a lever support shaft protruding from each said first connector housing side walls;

d) a plurality of operating levers each straddling one of said first connector housings, each said lever having two bearing holes into which said lever support shafts are fitted for rotatably mounting said operating levers on said first connector housings, each said operating lever having two recessed projection accommodating grooves extending from an edge of said lever to said bearing holes, respectively, for engaging said lever support shafts when mounting said lever on said first connector housing;

e) a pair of outer walls each having a fixed end and a free end and provided on each one of said first connector housings, each outer wall of said pair of outer walls being located outwardly of said first connector housing side walls, respectively, outside of said lever and covering said lever support shaft; and f) a plurality of cam projections provided on said second connector housings and engaging said respective lever to displace said respective first and second connector housings by cam action of said respective lever in a coupling direction and an uncoupling direction, wherein said first connector housings are integrally connected side by side to define a connector block with a predetermined clearance between adjacent outer walls, said predetermined clearance is such that a maximum deflection of one of said adjacent outer walls, at a location aligned with a portion of said respective bearing hole nearest said fixed end of said respective outer wall, is less than a depth of fit of said lever support shaft in said respective bearing hole as measured along an interior wall of said respective bearing hole remote from said respective accommodating groove.

8. The connector assembly as claimed in claim 7, wherein each said recessed groove is formed so as to deviate from a line extending between said cam projection and said lever support shaft at the point when a maximum resistance is reached when said operating lever is rotated to move said first connector housing and said second connector housing together.

9. The connector assembly as claimed in claim 8, wherein each said predetermined clearance is equal to a maximum amount of lateral deflection of one of said respective adjacent outer wall free ends, upon engagement of said respective support shaft in said respective accommodating groove.

10. The connector assembly as claimed in claim 7, wherein each said predetermined clearance is equal to a maximum amount of lateral deflection of one of said respective adjacent outer wall free ends upon engagement of said respective support shaft in said respective accommodating groove.

* * * * *